US012674593B2

(12) United States Patent
Jeong et al.

(10) Patent No.: US 12,674,593 B2
(45) Date of Patent: Jul. 7, 2026

(54) AIR CONDITIONER

(71) Applicant: LG ELECTRONICS INC., Seoul (KR)

(72) Inventors: Suhyeon Jeong, Seoul (KR); Sooyeon Shin, Seoul (KR); Geunyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 341 days.

(21) Appl. No.: 18/367,523

(22) Filed: Sep. 13, 2023

(65) Prior Publication Data

US 2024/0085041 A1 Mar. 14, 2024

(30) Foreign Application Priority Data

Sep. 14, 2022 (KR) ..... 10-2022-0115325

(51) Int. Cl.

| | |
|---|---|
| ***F24F 8/22*** | (2021.01) |
| ***F24F 1/0007*** | (2019.01) |
| ***F24F 1/0076*** | (2019.01) |
| ***F24F 13/10*** | (2006.01) |

(52) U.S. Cl.

CPC ..... *F24F 8/22* (2021.01); *F24F 13/10* (2013.01)

(58) Field of Classification Search

CPC ..... F24F 1/0007; F24F 8/22

See application file for complete search history.

(56) References Cited

FOREIGN PATENT DOCUMENTS

| | | | | |
|---|---|---|---|---|
| EP | 4 015 920 | | 6/2022 | |
| EP | 4015920 | A1 * | 6/2022 | ..... F24F 1/0025 |
| KR | 10-2020-0102864 | | 9/2020 | |
| KR | 20200102864 | A * | 9/2020 | ..... A61L 2/10 |

OTHER PUBLICATIONS

KR20200102864 and translation (Year: 2020).*

European Search Report issued in Application No. 23197259.7 dated Feb. 2, 2024.

* cited by examiner

*Primary Examiner* — Steven S Anderson, II

(74) *Attorney, Agent, or Firm* — KED & ASSOCIATES

(57) ABSTRACT

An air conditioner is provided that may include a case having an inlet and an outlet; a heat exchanger disposed inside of the case; a fan disposed inside of the case and elongated in a direction of a rotational axis of the fan; a guide that extends toward the outlet in a rotational direction of the fan; and a sterilizer mounted to the guide at a position facing the fan, and provided with a lamp that extends in a direction in which the fan extends, thereby providing a uniform sterilizing effect in a longitudinal direction of the fan.

22 Claims, 11 Drawing Sheets

AIR CONDITIONER

CROSS-REFERENCE TO RELATED APPLICATION(S)

This application claims priority under 35 U.S.C. § 119 to Korean Application No. 10-2022-0115325, filed in Korea on Sep. 14, 2022, whose entire disclosure(s) is/are hereby incorporated by reference.

BACKGROUND

1 Field

An air conditioner is disclosed herein.

2. Background

An air conditioner is a device that exchanges heat with air and supplies the heat-exchanged air to a room. An air-blowing fan is mounted inside of a case of the air conditioner. The fan causes indoor air to be drawn into the case through an inlet, and blows the drawn air into the room through an outlet.

Recently, a fan occupying a large volume in the air conditioner has generally been used in order to increase a cooling and heating capacity and an air-blowing capacity. However, existing air conditioners have a problem in that the entire large area of the fan is contaminated with foreign matter contained in the intake air. In addition, existing air conditioners also have a problem in that in order to sterilize or disinfect the entire area of the fan occupying a large space, a plurality of light sources is required, increasing production costs, and making it difficult to uniformly sterilize the entire area of the fan. Further, existing air conditioners also have a problem in that a light source module disposed in a passage for sterilizing a fan causes resistance to the airflow.

BRIEF DESCRIPTION OF THE DRAWINGS

Embodiments will be described in detail with reference to the following drawings in which like reference numerals refer to like elements, and wherein.

DETAILED DESCRIPTION

Figure 1:
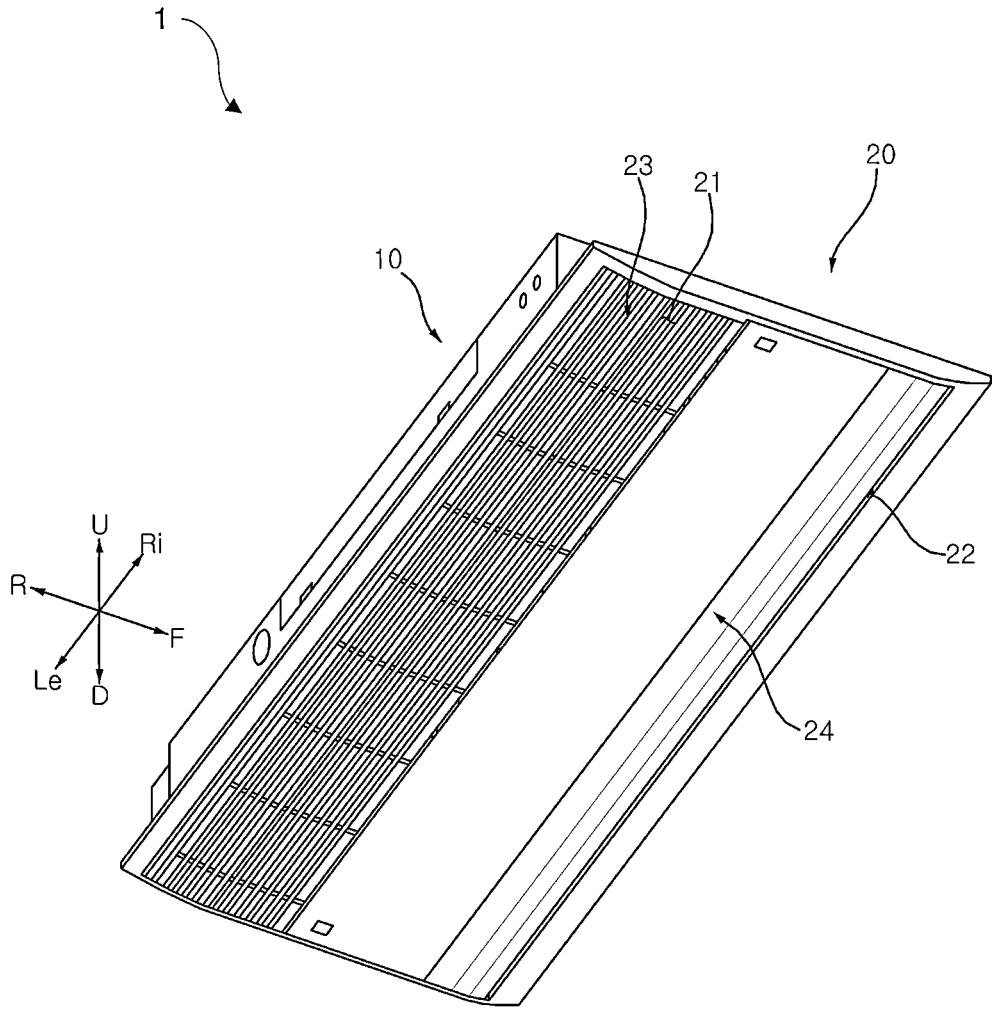
FIG. 1 is a perspective view of an air conditioner according to an embodiment.

Hereinafter, embodiments will be described with reference to the accompanying drawings, in which the same reference numerals are used throughout the drawings to designate the same or similar components, and redundant description has been omitted.

The terms "module" and "unit" for elements used in the following description are given simply in view of the ease of the description, and do not have a distinguishing meaning or role.

It will be noted that description of known arts will be omitted if it is determined that the description of the known arts can obscure the embodiments. Further, the accompanying drawings are used to help easily understand various technical features and it should be understood that the embodiments presented herein are not limited by the accompanying drawings. As such, embodiments should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms are intended to include the plural forms as well, unless the context clearly indicates otherwise.

Figure 2:
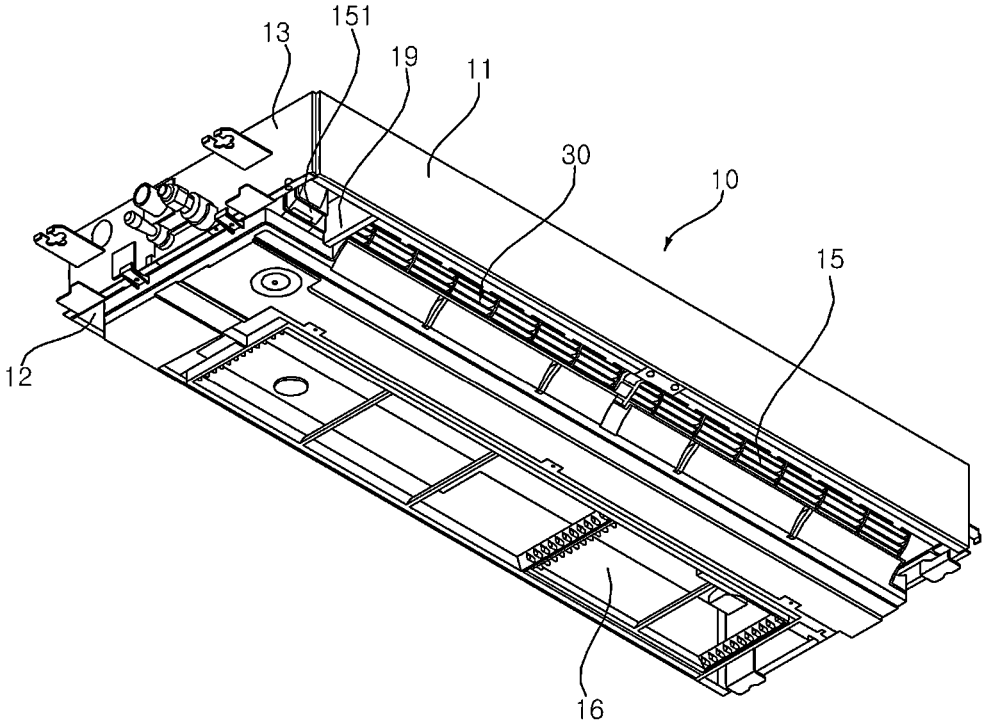
FIG. 2 is a partial view of an air conditioner according to an embodiment.

Referring to FIGS. 1 and 2, an air conditioner 1 will be described below.

FIG. 1 is a perspective view of an air conditioner 1 according to an embodiment. FIG. 2 is a perspective view of the air conditioner 1, from which a cover 20 is removed.

The air conditioner 1 may include a case 10. The case 10 may be installed on a ceiling of a room. The case 10 may have an internal space.

The air conditioner 1 may include the cover 20. The cover 20 may be disposed on a lower side of the case 10. The cover 20 may have a larger cross-sectional area than the case 10.

The air conditioner 1 may include an inlet 21. The inlet 21 may be formed in the cover 20. The inlet 21 formed in the cover 20 may be open at a top and bottom. Air in an interior space may be drawn into the case 10 through the inlet 21.

The air conditioner 1 may include an outlet 22. The outlet 22 may be formed in the cover 20. The outlet 22 formed in the cover 20 may be open at a top and bottom. Air in the case 10 may be supplied to the interior space through the outlet 22.

The inlet 21 and the outlet 22 may be spaced apart from each other in a frontward-rearward direction. The air, drawn into the case 10 through the inlet 21, may be supplied to the interior space through the outlet 22.

The air conditioner 1 may have an inlet grille 23. The inlet grille 23 may be disposed on the cover 20. The inlet 21 may be open in the inlet grille 23.

The air conditioner 1 may include a vane 24. The vane 24 may be rotatably mounted to the cover 20. The vane 24 may be rotatably mounted at the outlet 22. The vane 24 may open and close the outlet 22.

The air conditioner 1 may include a fan 15. The fan 15 may be disposed inside of the case 10. The fan 15 may draw in air from outside of the case 10 and blow the air through the outlet 22.

The air conditioner 1 may include a filter 16. The filter 16 may be disposed inside of the case 10. The filter 16 may be disposed on or at an upper side of the inlet 21.

The case 10 may include a front wall 11. The front wall 11 may be spaced forward from the fan 15. The outlet 22 may be disposed under the front wall 11.

The case 10 may include a rear wall 12. The rear wall 12 may be spaced rearward from the fan 15. The rear wall 12 may be spaced rearward from the front wall 11. The inlet 21 may be formed under the rear wall 12.

The case 10 may include a side wall 13. The side wall 13 may extend in the frontward-rearward direction. The side wall 13 may connect the front wall 11 and the rear wall 12.

The air conditioner 1 may include a partition wall 19. The partition wall 19 may be disposed in the case 10. The partition wall 19 may be spaced apart from the side wall 13. The partition wall 19 may face the fan 15.

The air conditioner 1 may include a fan motor 151. The fan motor 151 may be coupled to the fan 15. The fan motor 151 may be disposed in the case 10. The fan motor 151 may be disposed between the side wall 13 and the partition wall 19.

The air conditioner 1 may include a front guide 30. The front guide 30 may be detached from the front wall 11. The front guide 30 may be disposed on or at an upper side of the outlet 22. The front guide 30 may be made of an Expanded Polystyrene (EPS) material, for example. The front guide 30 may be a sound insulating material. The front guide 30 may be disposed between the fan 15 and the front wall 11. The front guide 30 may guide a flow direction of air blown through the outlet 22.

Figure 3:
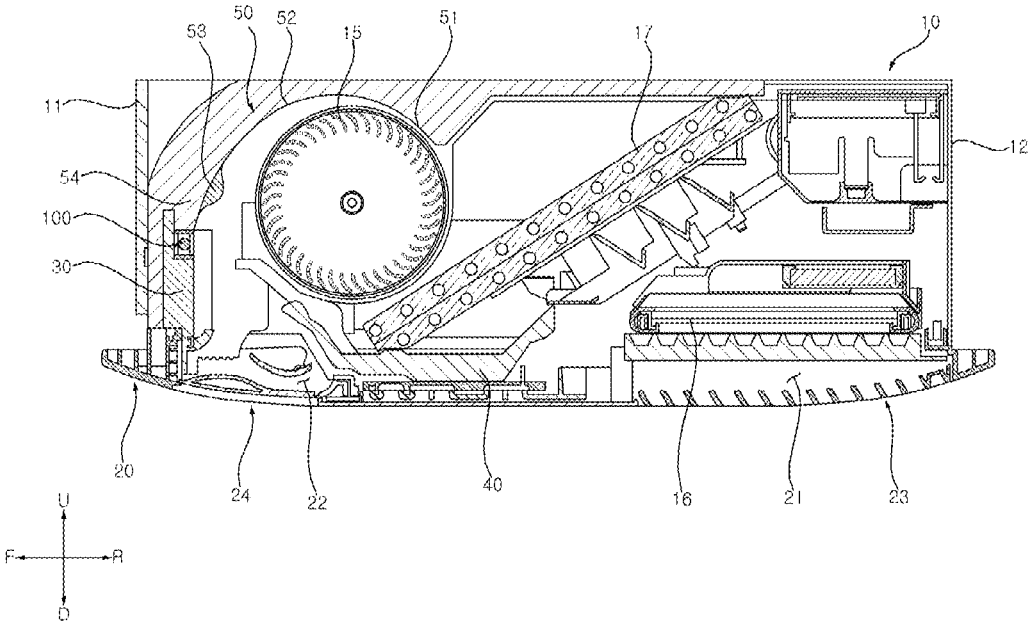
FIG. 3 is a cross-sectional view of an air conditioner according to an embodiment.

Referring to FIG. 3, the air conditioner 1 will be described below.

FIG. 3 is a vertical cross-sectional view of an air conditioner 1.

The air conditioner 1 may include a heat exchanger 17. The heat exchanger 17 may be disposed inside of the case 10. The heat exchanger 17 may be an evaporator.

The air conditioner 1 may include a drain pan 40. The drain pan 40 may be disposed inside of the case 10. The drain pan 40 may be disposed on or at a lower side of the heat exchanger 17.

The air drawn into the case 10 through the inlet 21 may be cooled by passing through the heat exchanger 17. The air, having passed through the heat exchanger 17, may be blown by the fan 15 to be discharged outside of the case 10 through the outlet 22.

The heat exchanger 17 may generate condensate by heat exchange with the air. The condensate generated in the heat exchanger 17 may be stored in the drain pan 40.

The air conditioner 1 may include a rear guide 50. The rear guide 50 may extend in a rotational direction of the fan 15. The rear guide 50 may be connected to the front guide 30. The rear guide 50 may be coupled to the front wall 11.

The air conditioner 1 may include a guide. The guide may include the rear guide 50 and the front guide 30. The guide may be a concept collectively referring to the rear guide 50 and the front guide 30.

The rear guide 50 may include a first guide 51. The first guide 51 may be disposed between the heat exchanger 17 and the fan 15. The first guide 51 may extend in the rotational direction of the fan 15.

The rear guide 50 may include a second guide 52. The second guide 52 may be disposed between the fan 15 and the front wall 11. The second guide 52 may extend in the rotational direction of the fan 15. The first guide 51 and the second guide 52 may be integrally formed.

The rear guide 50 may include a guide protrusion 53. The guide protrusion 53 may protrude toward the fan 15.

The rear guide 50 may include a third guide 54. The third guide 54 may extend in the rotational direction of the fan 15. The third guide 54 may extend downward from the second guide 52. The second guide 52 and the third guide 54 may be integrally formed. The guide protrusion 53 may protrude from the third guide 54 toward the fan 15. The third guide 54 may extend in a vertical or upward-downward direction, and may be connected to the front wall 11 and the cover 20. The third guide 54 may extend toward the outlet 22 and may have a space recessed toward the front wall 11.

The air conditioner 1 may include a sterilizer 100. The sterilizer 100 may be disposed to face the fan 15. The sterilizer 100 may emit ultraviolet rays toward the fan 15.

The front guide 30 may be connected to the rear guide 50. The front guide 30 may be coupled to a recessed portion of the rear guide 50. The front guide 30 is detachable from the front wall 11 and the rear guide 50. The front guide 30 may form a continuous surface with the rear guide 50.

The sterilizer 100 may be mounted to the front guide 30. The sterilizer 100 may be mounted to the front guide 30 at a position facing the fan 15. The sterilizer 100 may be disposed on or at a lower side of the second guide 52. The sterilizer 100 may be disposed below the guide protrusion 53. The sterilizer 100 may be disposed downstream of the rear guide 50. The sterilizer 100 may form a continuous surface with the rear guide 50 and the front guide 30.

Figure 4:
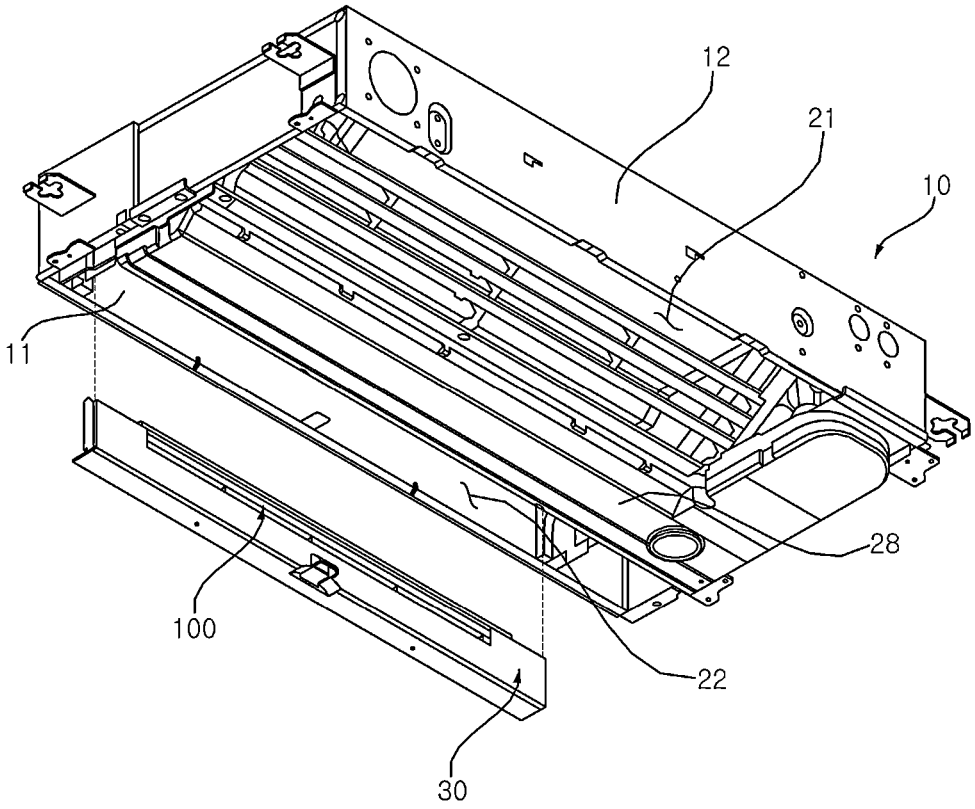
FIG. 4 is a partial view of an air conditioner according to an embodiment.

Referring to FIG. 4, the air conditioner 1 will be described below.

FIG. 4 is a view of the air conditioner 1, from which some of the internal components of the cover 20 and the case 10 are removed. The case 10 may include a bottom wall 28 disposed between the front wall 11 and the rear wall 12. The bottom wall 28 may be disposed between the inlet 21 and the outlet 22. The drain pan 40 (see FIG. 3) may be disposed on or at an upper side of the bottom wall 28. The outlet 22 may be formed between the bottom wall 28 and the front wall 11.

The front guide 30 may be inserted between the front wall 11 and the bottom wall 28. The front guide 30 may be detached from the front wall 11.

The sterilizer 100 may be coupled to the front guide 30. The sterilizer 100 may be inserted into a space formed inside of the front guide 30. The sterilizer 100 may be coupled to the front wall 11 along with the front guide 30.

Figure 5:
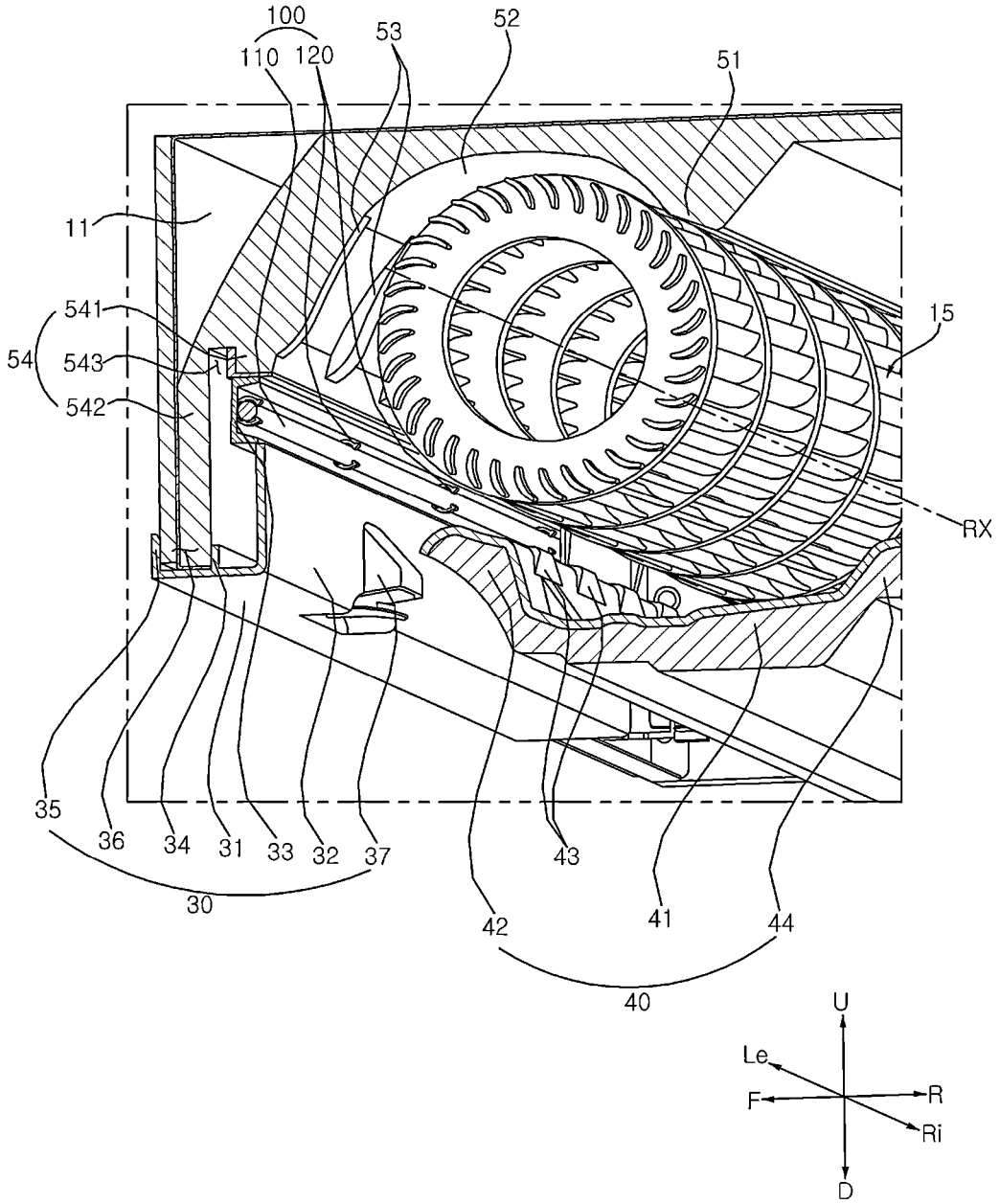
FIG. 5 is a partial view of an air conditioner according to an embodiment.
Figure 6:
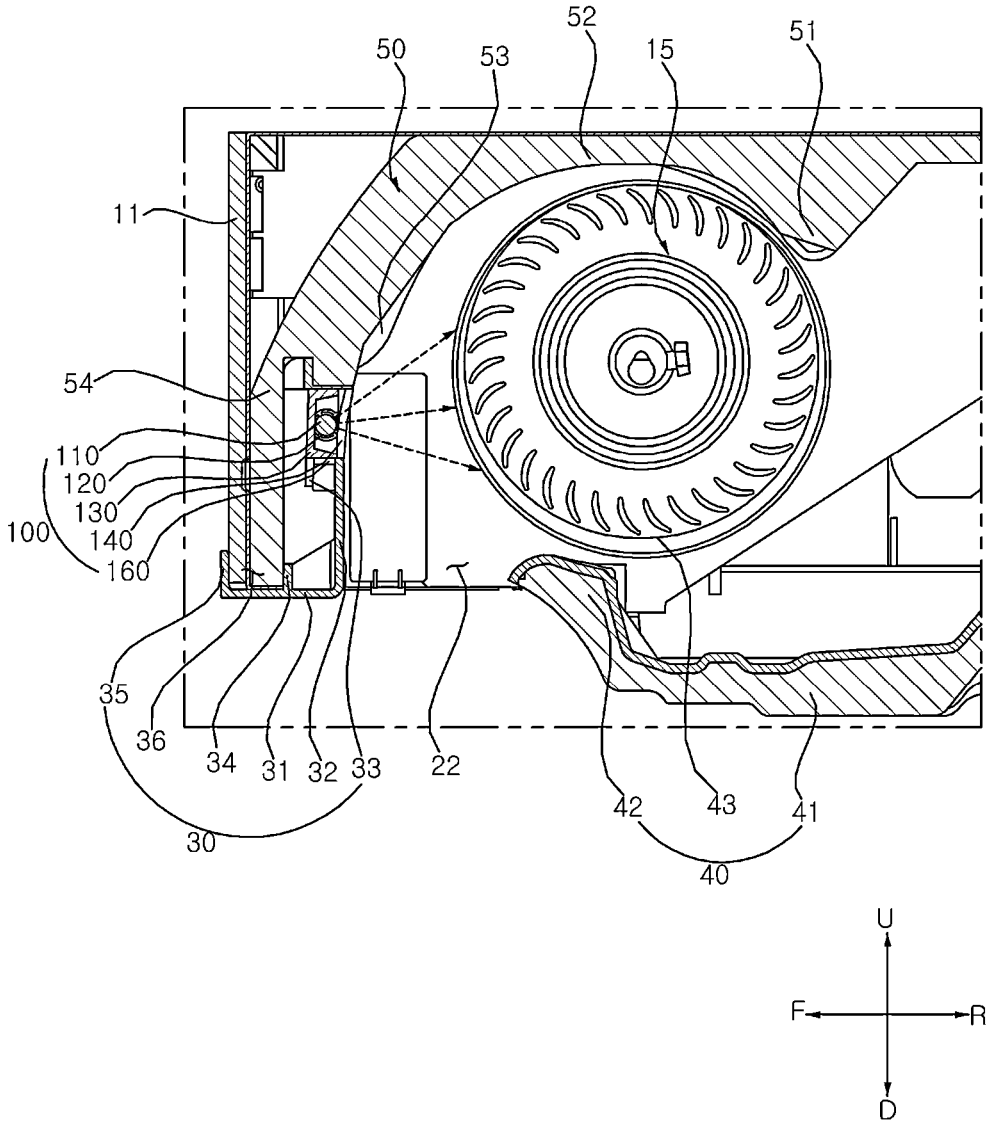
FIG. 6 is a partial view of an air conditioner according to an embodiment.

Referring to FIGS. 5 and 6, the air conditioner 1 will be described below.

FIG. 5 is a vertical cross-sectional view of the case 10, showing an oblique view of a portion of an internal structure thereof. FIG. 6 is a vertical cross-sectional view of the case 10, showing an internal structure thereof.

The rear guide 50 may be disposed to surround the fan 15. The first guide 51 and the second guide 52 may surround the fan 15.

The guide protrusion 53 may protrude toward the fan 15. The guide protrusion 53 may be disposed above the sterilizer 100.

The fan 15 may have a rotational axis RX. The rotational axis RX may extend in a direction orthogonal to the frontward-rearward direction. In addition, the rotational axis RX may extend in a direction orthogonal to the vertical direction.

A plurality of guide protrusions 53 may be spaced apart from each other in a direction of the rotational axis RX. The plurality of guide protrusions 53 may be spaced apart from each other in a direction in which the fan 15 extends.

The fan 15 may be a cross flow fan. The fan 15 may draw in air in a direction intersecting the rotational axis RX and may blow the air toward the outlet 22.

The third guide 54 may extend vertically. The third guide 54 may be part of the rear guide 50. The third guide 54 may be referred to as a "lower guide."

The lower guide 54 may include a first body 541 that protrudes downward from a lower end of the second guide 52. The first body 541 may be disposed under the guide protrusion 53. The first body 541 may face the fan 15. The first body 541 may be disposed on or at an upper side of the sterilizer 100.

The lower guide 54 may include a second body 542. The second body 542 may extend downward from a lower end of the second guide 52. The second body 542 may be coupled to the front wall 11. The second body 542 may be spaced forward from the first body 541. The second body 542 may be disposed between the first body 541 and the front wall 11.

The lower guide 54 may have a gap 543. The gap 543 may be formed between the first body 541 and the second body 542. The gap 543 may refer to a space formed between the second body 542 and the front guide 30.

The front guide 30 may include a first plate 31. The first plate 31 may be disposed on or at a lower side of the front wall 11. The first plate 31 may be disposed on or at a lower side of the lower guide 54. The first plate 31 may extend in a direction in which the rotational axis RX extends.

The front guide 30 may include a second plate 32. The second plate 32 may extend upward from the first plate 31. The second plate 32 may be disposed between the lower guide 54 and the fan 15. The second plate 32 may face the drain pan 40. A portion of the outlet 22 may be formed between the second plate 32 and the drain pan 40.

The front guide 30 may include a device coupling portion 33. The device coupling portion 33 may be disposed between the lower guide 54 and the fan 15. The device coupling portion 33 may be a portion recessed from the second plate 432 toward the front wall 11. The device coupling portion 33 may be coupled to the sterilizer 100. The device coupling portion 33 may be coupled to the first body 541 of the lower guide 54. The device coupling portion 33 may be inserted into the gap 543 to be fixed therein.

The front guide 30 may include a first rib 34. The first rib 34 may protrude upward from the first plate 31. The first rib 34 may be disposed between the lower guide 54 and the second plate 32.

The front guide 30 may include a second rib 35. The second rib 35 may protrude upward from the first plate 31. The second rib 35 may be spaced forward from the first rib 34.

The front guide 30 may include a groove 36. The groove 36 may be formed between the first rib 34 and the second rib 35. The first rib 34 and the second rib 35 may extend in the direction of the rotational axis RX. The groove 36 may extend in the direction of the rotational axis RX.

A lower end of the front wall 11 and a lower end of the lower guide 54 may be inserted into the groove 36. The first rib 34 and the second rib 35 may support the front wall 11 and the lower guide 54.

The front guide 30 may include a lower protrusion 37. The lower protrusion 37 may protrude from the second plate 32. The lower protrusion 37 may be disposed below the sterilizer 100. The lower protrusion 37 may be disposed below the fan 15. The lower protrusion 37 may face the drain pan 40 in the frontward-rearward direction.

The drain pan 40 may be disposed below the fan 15. The drain pan 40 may face the front guide 30 in the frontward-rearward direction. The drain pan 40 may extend in the direction of the rotational axis RX.

The drain pan 40 may include a base 41. The base 41 may be spaced downward from the fan 15. The condensate generated in the heat exchanger 17 (see FIG. 3) may be collected in the base 41.

The drain pan 40 may include a first drain pan wall 42. The first drain pan wall 42 may protrude upward from the base 41. The first drain pan wall 42 may extend in the direction of the rotational axis RX. The first drain pan wall 42 may be bent toward the front guide 30.

The drain pan 40 may include a drain pan protrusion 43. The drain pan protrusion 43 may be formed under the fan 15. The drain pan protrusion 43 may protrude from the first drain pan wall 42. There may be a plurality of drain pan protrusions 43 spaced apart from each other in the direction of the rotational axis RX. The drain pan protrusions 43 may be spaced apart from the front guide 30 in the frontward-rearward direction. The drain pan protrusions 43 may be disposed downstream of the guide protrusion 53.

The drain pan 40 may include a second drain pan wall 44. The second drain pan wall 44 may protrude upward from the base 41. The second drain pan wall 44 may extend in the direction of the rotational axis RX. The second drain pan wall 44 may be bent toward an upstream side of the fan 15. The first drain pan wall 42 and the second drain pan wall 44 may be spaced apart from each other in the frontward-rearward direction.

A portion of the outlet 22 may be formed between the front guide 30 and the drain pan 40. The first drain pan wall 42 and the second plate 32 may be spaced apart from each other to form the outlet 22.

The sterilizer 100 may be mounted to the front guide 30. The sterilizer 100 may be connected to the device coupling portion 33 of the front guide 30.

The sterilizer 100 may be disposed downstream of the rear guide 50. The sterilizer 100 may be disposed on or at a lower side of the second guide 52. The sterilizer 100 may be disposed below the guide protrusion 53.

The sterilizer 100 may be disposed to face the fan 15. The sterilizer 100 may emit ultraviolet rays toward the fan 15.

The sterilizer 100 may be disposed above the lower protrusion 37. The sterilizer 100 may be disposed under the first body 541. The sterilizer 100 may be disposed above the drain pan 40.

The sterilizer 100 may form a continuous surface with the rear guide 50 and the front guide 30. Respective surfaces of the rear guide 50, the sterilizer 100, and the front guide 30 that face the fan 15 may form a continuous surface in the rotational direction of the fan 15.

The sterilizer 100 may include a lamp 110. The lamp 110 may be elongated in a direction in which the fan 15 extends. The lamp 110 may be elongated in the direction of the rotational axis RX.

The sterilizer 100 may include a holder 120. The holder 120 may surround the lamp 110. A plurality of holders 120 may be spaced apart from each other in a direction in which the lamp 110 extends.

The sterilizer 100 may include a lamp case 130. The lamp case 130 may have an internal space. The lamp 110 may be disposed in the lamp case 130. The lamp case 130 may be disposed in the device coupling portion 33. The device coupling portion 33 may be recessed from the second plate 32 toward the front wall 11, and the lamp case 130 may be disposed in the recessed space of the device coupling portion 33. The holder 120 may protrude from the lamp case 130 toward the fan 15.

The sterilizer 100 may include a case cover 140. The case cover 140 may be coupled to the lamp case 130. The case cover 140 may be disposed between the lamp 110 and the fan 15. The case cover 140 may be made of a light-transmissive material. A surface of the case cover 140 that faces the fan 15 may form a continuous surface with one surface of the rear guide 50 and one surface of the front guide 30. The lamp 110 may be disposed in a space between the lamp case 130 and the case cover 140. Light emitted from the lamp 110 may be transmitted through the case cover 140 to be emitted toward the fan 15.

The sterilizer 100 may include a light emitting portion 160. The light emitting portion 160 may be connected to the lamp 110. The light emitting portion 160 may receive power from an external power source (not shown) to emit light. The light emitting portion 160 may be coupled to the lamp case 130. The light emitting portion 160 may be disposed at one end in the direction in which the lamp 110 extends.

Figure 7:
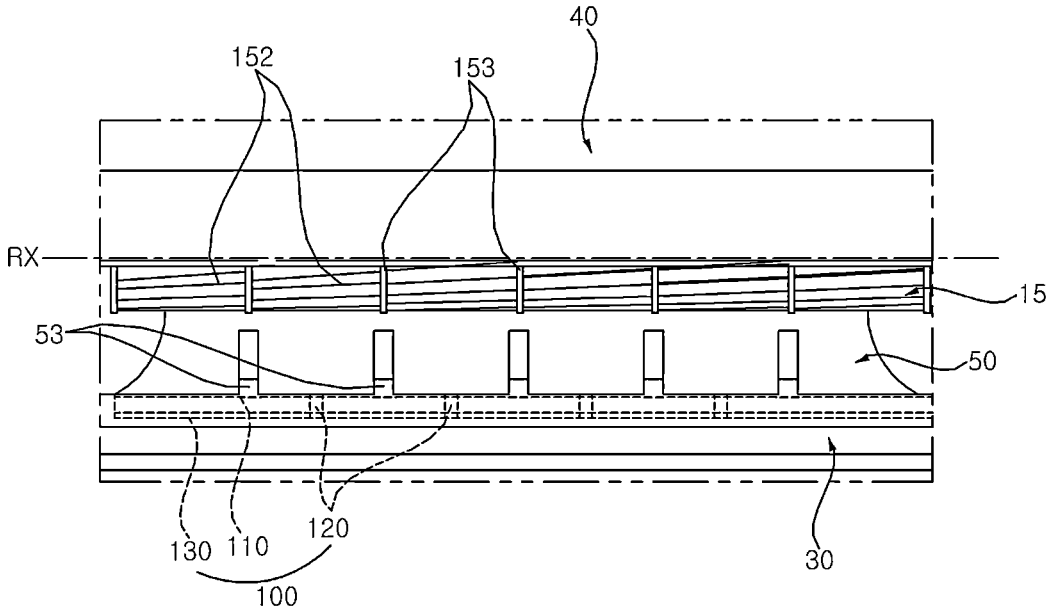
FIG. 7 is a partial view of an air conditioner according to an embodiment.

Referring to FIG. 7, the air conditioner 1 will be described below.

FIG. 7 is a view illustrating an area near the outlet 22 of the case 10, when viewed from bottom to top.

The fan 15 may have the rotational axis RX. The fan 15 may rotate about the rotational axis RX.

The fan 15 may include a plurality of blades 152. The plurality of blades 152 may extend in the direction of the rotational axis RX.

The fan 15 may include a plurality of partition plates 153. The plurality of partition plates 153 may be disposed between the plurality of blades 152.

The plurality of guide protrusions 53 may be spaced apart from each other in the direction of the rotational axis RX. The plurality of guide protrusions 53 may protrude from the rear guide 50 toward the fan 15. The respective guide protrusions 53 may be disposed at positions corresponding to the plurality of partition plates 153. The plurality of guide protrusions 53 and the plurality of partition plates 153 may face each other in the frontward-rearward direction.

The sterilizer 100 may include the lamp 110 extending in the direction of the rotational axis RX. The lamp 110 may extend in the direction in which the fan 15 extends. The lamp 110 may uniformly project light in the direction in which the fan 15 extends. Accordingly, the light projected from the lamp 110 may be uniformly emitted over an entire area of the fan 15. The light emitted from the lamp 110 toward the fan 15 may sterilize the fan 15.

The sterilizer 100 may include the lamp case 130 extending in the direction of the rotational axis RX. The lamp case 130 may be inserted into the front guide 30 to be fixed therein.

The plurality of holders 120 may be spaced apart from each other in the direction in which the lamp 110 extends. The holders 120 may be disposed between the plurality of guide protrusions 53.

Figure 8:
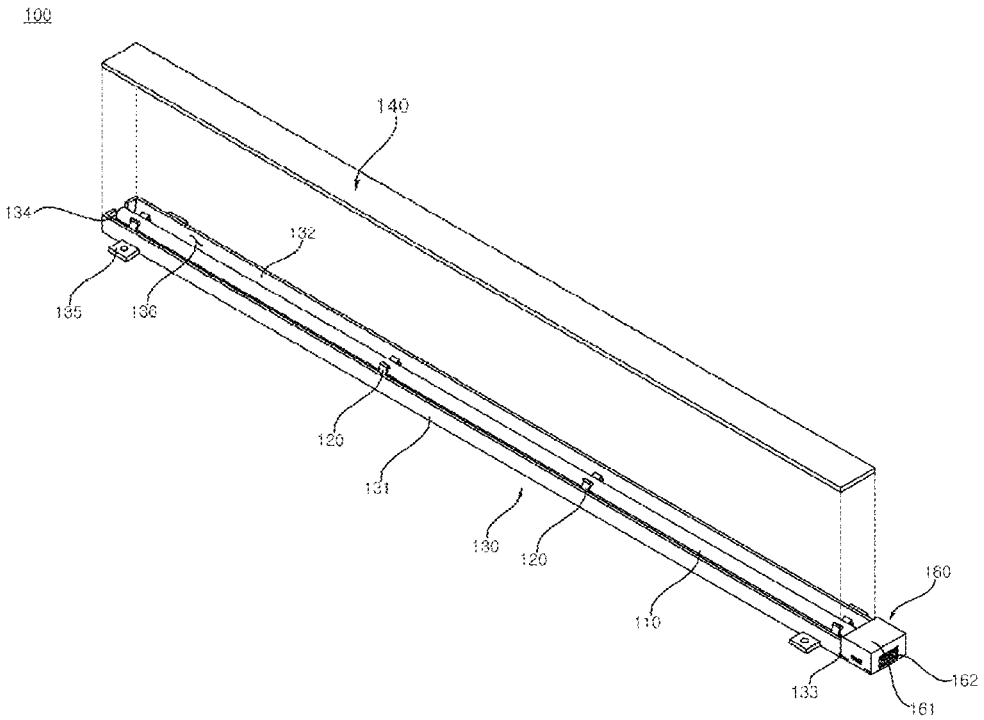
FIG. 8 is a perspective view of a sterilizer according to an embodiment.
Figure 9:
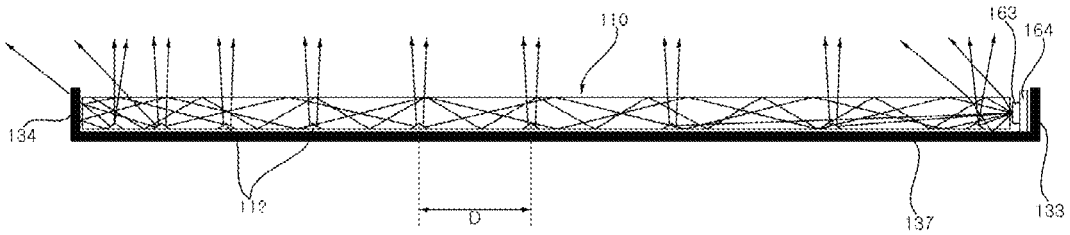
FIG. 9 is a partial view of a sterilizer according to an embodiment.
Figure 10:
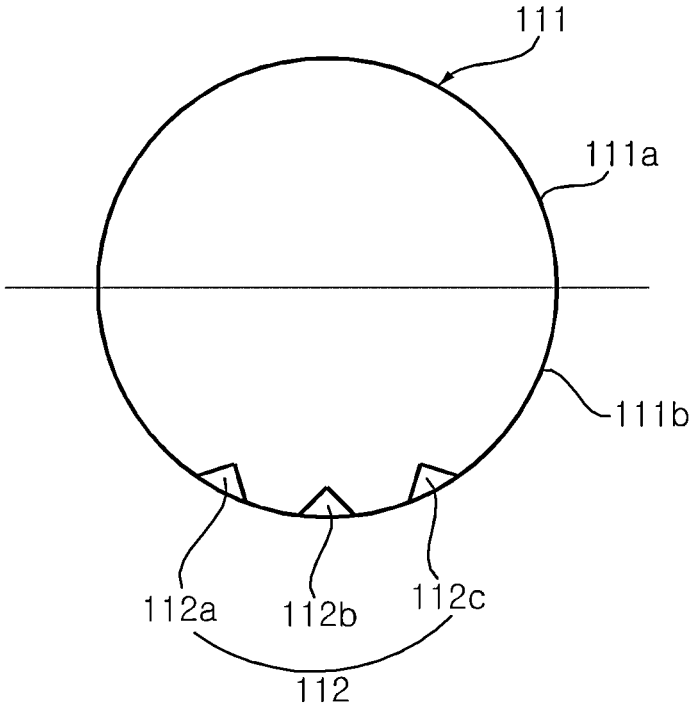
FIG. 10 is a partial view of a sterilizer according to an embodiment.

Referring to FIGS. 8 to 10, the sterilizer 100 will be described below.

FIG. 8 is a perspective view of the sterilizer 100. FIG. 9 is a schematic diagram illustrating a traveling direction of light in the sterilizer 100. FIG. 10 is a vertical cross-sectional view of the lamp 110.

The lamp case 130 may be elongated in the direction in which the fan 15 (see FIG. 7) extends. The lamp 110 and the holders 120 may be disposed in the lamp case 130.

The lamp case 130 may include a first case wall 131. The first case wall 131 may extend in the direction in which the lamp 110 extends.

The lamp case 130 may include a second case wall 132. The second case wall 132 may extend in the direction in which the lamp 110 extends.

The first case wall 131 and the second case wall 132 may be spaced apart from each other. The lamp 110 may be disposed between the first case wall 131 and the second case wall 132.

The lamp case 130 may include a lamp receiving space 136. The lamp receiving space 136 may be a space between the first case wall 131 and the second case wall 132. The lamp 110 may be disposed in the lamp receiving space 136.

The lamp case 130 may include a first end 133. The first end 133 may connect the first case wall 131 and the second case wall 132. The first end 133 may face one (first) end of the lamp 110.

The lamp case 130 may include a second end 134. The second end 134 may connect the first case wall 131 and the second case wall 132. The second end 134 may face another (second) end of the lamp 110.

The lamp receiving space 136 may be formed between the first end 133 and the second end 134. The lamp 110 may extend from the first end 133 toward the second end 134.

The lamp case 130 may include coupling ribs 135. The coupling ribs 135 may protrude outside the lamp case 130. The coupling ribs 135 may be coupled to the front guide 30 (see FIG. 7).

The lamp case 130 may include a case bottom wall 137. The case bottom wall 137 may be disposed under the lamp 110. The holders 120 may protrude upward from the case bottom wall 137.

The case cover 140 may open and close the lamp receiving space 136. The case cover 140 may be removed from the lamp case 130. The case cover 140 may form a surface of the sterilizer 100 that faces the fan 15.

The sterilizer 100 may include the light emitting portion 160. The light emitting portion 160 may be coupled to one side of the lamp case 130. The light emitting portion 160 may be coupled to the first end 130.

The light emitting portion 160 may be electrically connected to an external power source (not shown). The light emitting portion 160 may generate light that is emitted toward the lamp 110.

The light emitting portion 160 may include a light source case 161. The light source case 161 may be coupled to the lamp case 130. The light source case 161 may be disposed on or at one side of the first end 133.

The light emitting portion 160 may include a substrate 162. The substrate 162 may receive power from the external power source (not shown). The substrate 162 may be a printed circuit board (PCB). An electric circuit may be printed on the substrate 162. The substrate 162 may be disposed in the light source case 161.

The light emitting portion 160 may include a light source 163. The light source 163 may emit light toward the lamp 110. The light source 163 may be disposed in the lamp case 130. The light source 163 may be disposed between the first end 133 and the second end 134.

The light emitting portion 160 may include a supporter 164. The supporter 164 may be coupled to the first end 133. The light source 163 may be coupled to the supporter 164. The light source 163 may pass through the first end 133 and the supporter 164 to protrude into the lamp case 130. The light source 163 may pass through the first end 133 and the supporter 164 to be electrically connected to the substrate 162.

The light source 163 may be electrically connected to the substrate 162 and may generate light using power transmitted through the substrate 162. The light generated by the light source 163 may travel in the direction in which the lamp 110 extends. The lamp 110 may be made of a light-reflective or light-transmissive material. The light generated by the light source 163 may be reflected or refracted from or transmitted into the lamp 110 to diffuse in a longitudinal direction of the lamp 110.

The lamp 110 may include a pattern portion 112. The pattern portion 112 may be formed in the lamp 110. The pattern portion 112 may include a serration pattern. The pattern portion 112 may be formed in a protruding shape that protrudes into the lamp 110. There may be a plurality of pattern portions 112 spaced apart from each other in the longitudinal direction of the lamp 110. The respective pattern portions 112 may be spaced at a predetermined interval D.

The lamp 110 may include a housing 111. The housing 111 may have a cylindrical shape. The housing 111 may be made of a light-reflective or light-transmissive material.

The housing 111 may include a housing upper portion 111*a* and a housing lower portion 111*b*. The housing upper portion 111*a* and the housing lower portion 111*b* may be integrally formed.

The pattern portion 112 may be formed at a lower portion of the lamp 110. The pattern portion 112 may be formed at a position adjacent to the case bottom wall 137. The pattern portion 112 may be formed at the housing lower portion 111*b*.

The pattern portion 112 may be formed in a protruding shape that protrudes into the lamp 110. The pattern portion 112 may include a plurality of pattern protrusions 112*a*, 112*b*, and 112*c* which are spaced apart from each other around a circumference of the lamp 110. The pattern protrusions 112*a*, 112*b*, and 112*c* may include first pattern protrusion 112*a*, second pattern protrusion 112*b*, and third pattern protrusion 112*c*. The respective first, second, and third pattern protrusions 112*a*, 112*b*, and 112*c* may protrude toward a center of the lamp 110.

The light emitted from the light source 163 toward the lamp 110 may be refracted, reflected, or transmitted within the housing 111. In this case, the pattern portion 112 may facilitate refraction or reflection of light, thereby facilitating light diffusion in the longitudinal direction of the lamp 110. There may be a plurality of pattern portions 112 spaced apart from each other in the longitudinal direction of the lamp 110, and the light emitted from the light source 163 may be diffused in the longitudinal direction of the lamp 110 by the plurality of pattern portions 112.

Figure 11:
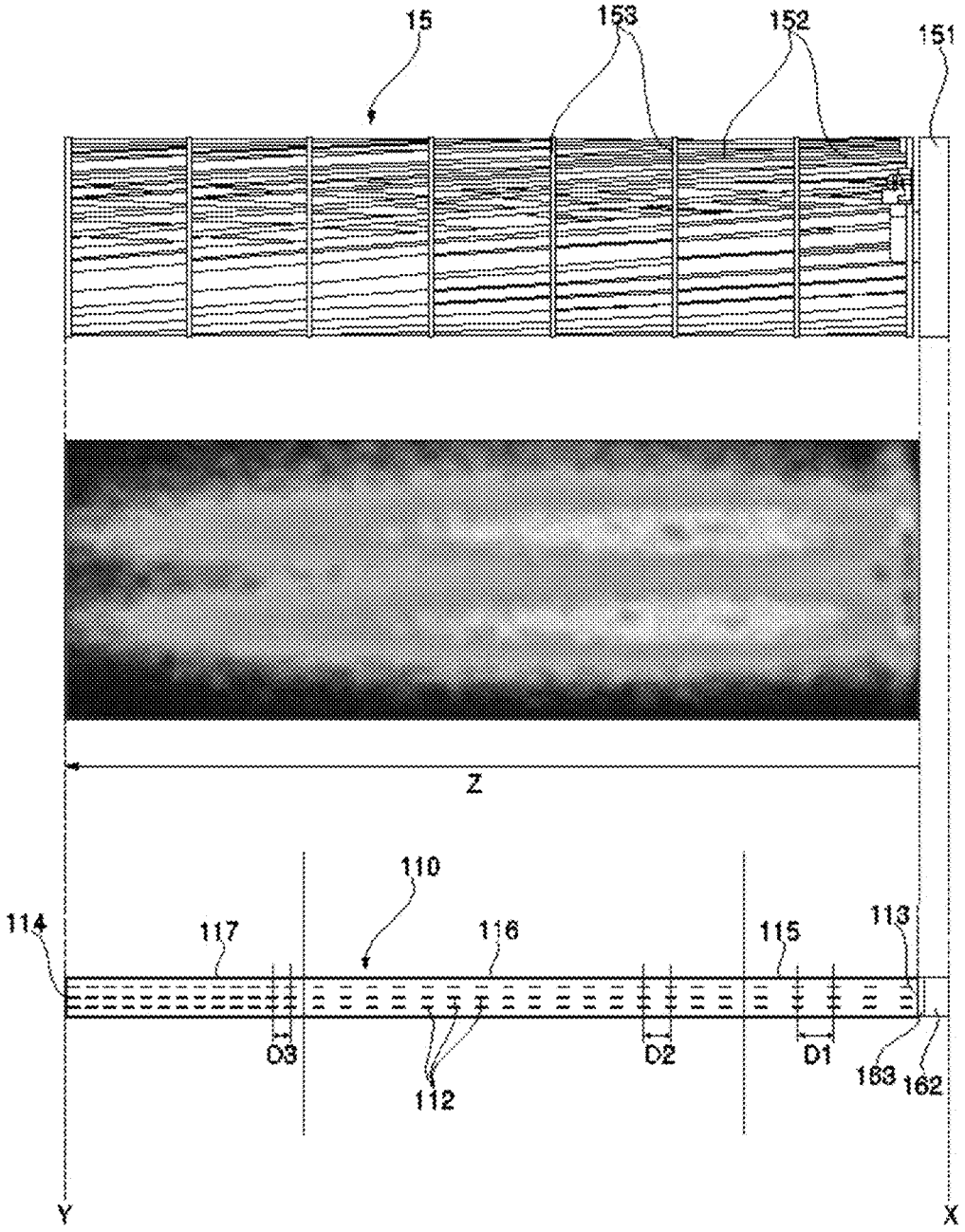
FIG. 11 is a view conceptually illustrating a portion of an air conditioner according to an embodiment.

Referring to FIG. 11, the air conditioner 1 will be described below.

FIG. 11 is a view conceptually illustrating a relative arrangement between the fan 15 and the sterilizer 100 and a light diffusion effect.

In the following description, a first side on which the fan motor 151 is disposed will be defined as a first position X. A second side which is spaced apart from the fan motor 151 in the extending direction of the fan 15 will be defined as a second position Y. A direction from the first position X toward the second position Y will be defined as a traveling direction Z.

The fan motor 151 may be disposed at the first position X. The fan 15 may extend from the first position X toward the second position Y. The blades 152 may extend in a direction from the first position X toward the second position Y. The plurality of partition plates 153 may be spaced apart from each other in the direction from the first position X toward the second position Y.

The substrate 162 may be disposed at the first position X. That is, the substrate 162 may be disposed at a position corresponding to the fan motor 151 in the frontward-rearward direction, thereby facilitating management of electric components 162 and 151 connected to the external power source (not shown). In addition, electric wires (not shown) that connect the electric components 162 and 151 may decrease in length, and assembly may be facilitated.

The light source 163 may be disposed closer to the first position X than to the second position Y. The light emitted from the light source 163 may be diffused into the lamp 110 in the traveling direction Z.

The lamp 110 may include a first lamp end 113. The first lamp end 113 may be connected to the light source 163. The first lamp end 113 may be disposed adjacent to the first position X.

The lamp 110 may include a second lamp end 114. The second lamp end 114 may be spaced apart from the first lamp end 113 in the longitudinal direction of the lamp 113. The second lamp end 114 may be disposed adjacent to the second position Y.

The lamp 110 may extend from the first lamp end 113 to the second lamp end 114. The plurality of pattern portions 112 may be spaced apart from each other between the first lamp end 113 and the second lamp end 114.

The lamp 110 may be divided into a plurality of sections 115, 116, and 117. A section from the first lamp end 113 to a position spaced apart from the first lamp end 113 by a predetermined distance in the traveling direction Z may be defined as a first section 115. A section from the first section 115 to a position spaced apart from the first section 115 by a predetermined distance in the traveling direction Z may be defined as second section 116. A section from the second section 116 to the second lamp end 114 may be defined as third section 117. The first, second, and third sections 115, 116, and 117 may be integrally formed.

The plurality of pattern portions 112 may be formed in the respective first, second, and third sections 115, 116, and 117. The plurality of pattern portions 112 may be formed inside of each of the sections 115, 116, and 117.

The plurality of pattern portions 112 may be spaced at intervals D1, D2, and D3 which may become narrower further away from the light source 163, as shown in FIG. 11. The interval D1 between the plurality of pattern portions 112 in the first section 115 may be greater than the interval D2 between the plurality of pattern portions 112 in the second section 116. The interval D2 between the plurality of pattern portions 112 in the second section 116 may be greater than the interval D3 between the plurality of pattern portions 112 in the third section 117. Accordingly, the intervals between the plurality of pattern portions 112 become narrower further away from the light source 163, thereby facilitating refraction or reflection of light at a position away from the light source 163. Accordingly, the light emitted from the light source 163 to the lamp 110 may be uniformly diffused in the longitudinal direction of the lamp 110 and may be uniformly projected in the longitudinal direction of the fan 15.

While embodiments have been particularly shown and described, the embodiments shall not be limited to the particular embodiments described above, and it will be understood by an ordinary skilled person in the art that various changes in form and details may be made therein without departing from the spirit and scope as defined by the claims, and alternative embodiments should not be individually understood from the inventive concept and prospect.

It will be apparent to those skilled in the art that various modifications and variations can be made, and thus, the embodiments should not be construed as being limited to the aforementioned embodiments. Therefore, it is intended that the embodiments cover modifications and variations provided they come within the scope of the appended claims and their equivalents.

Certain embodiments or other embodiments described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Embodiments disclosed herein solve the above and other problems.

Embodiments disclosed herein are configured to sterilize a fan.

Further, embodiments disclosed herein are configured to uniformly sterilize a large area of a fan.

Furthermore, embodiments disclosed herein are configured to simplify a structure of a sterilizer.

Also, embodiments disclosed herein are configured to eliminate flow resistance.

Additionally, embodiments disclosed herein are configured to simplify assembly of a sterilizer.

Advantages of embodiments are not limited to the aforementioned advantages and other advantages not described herein will be clearly understood by those skilled in the art from the following description.

Embodiments disclosed herein provide an air conditioner that may include a case having an inlet and an outlet. The air conditioner may include a heat exchanger disposed inside of the case. The air conditioner may further include a fan disposed inside of the case and elongated in a direction of a rotational axis.

The air conditioner may include a guide that extends toward the outlet in a rotational direction of the fan. The air conditioner may include a sterilizer mounted to the guide at a position facing the fan, and may be provided with a lamp that extends in a direction in which the fan extends, thereby providing a uniform sterilizing effect in a longitudinal direction of the fan.

The guide may include a rear guide that extends in the rotational direction of the fan. The guide may include a front guide disposed downstream of the rear guide and extending toward the outlet.

The sterilizer may be mounted to the front guide. The sterilizer may be coupled to the front guide to be detachable from the case. The front guide may include a device coupling portion recessed in a direction away from the fan, and providing a space in which the sterilizer is disposed.

The sterilizer may include a lamp case in which the lamp is accommodated, and which is coupled to the front guide. The sterilizer and the front guide may extend in the direction of the rotational axis of the fan. The sterilizer may form a continuous surface with a surface of the front guide that faces the fan.

The case may include a front wall spaced from one side of the fan. The front guide may include a first plate disposed under the front wall and the rear guide. The front guide may include a first rib that protrudes upward from the first plate. The front guide may include a second rib that protrudes upward from the first plate and spaced apart from the first rib. The front wall and the rear guide may be inserted between the first rib and the second rib.

The front guide may include a lower protrusion that protrudes toward the outlet and disposed below the sterilizer. The sterilizer may include a case cover that forms a continuous surface with a surface of the rear guide that faces the fan.

The rear guide may include a guide protrusion that protrudes toward the fan and disposed above the sterilizer. The rear guide may include a plurality of guide protrusions that protrudes toward the fan, and spaced apart from each other in the direction in which the fan extends. The sterilizer may include holders disposed at positions between the plurality of guide protrusions.

The air conditioner may include a drain pan disposed on or at a lower side of the heat exchanger and disposed below the sterilizer. The drain pan may include a base disposed on or at a lower side of the heat exchanger.

The drain pan may include a first drain pan wall that extends from the base toward the sterilizer, and disposed below the sterilizer. The drain pan may include a drain pan protrusion that protrudes from the first drain pan wall in a direction away from the sterilizer.

The sterilizer may include a light emitting portion disposed on or at one side of the lamp and having a light source connected to the lamp. The air conditioner may include a fan motor disposed on or at one side of the fan and coupled to the fan. The light emitting portion may be disposed at a position corresponding to the fan motor.

The sterilizer may include a plurality of pattern portions that protrudes toward a center of the lamp, and spaced apart from each other in a direction in which the lamp extends. The plurality of pattern portions may be spaced at intervals that are set differently in a longitudinal direction of the lamp.

The sterilizer may include a light source disposed on or at one side of the lamp and connected to the lamp. The intervals between the plurality of pattern portions may become narrower away from the light source.

According to at least one of the embodiments disclosed herein, a fan may be sterilized by providing a sterilizer facing the fan.

According to at least one of the embodiments disclosed herein, a large area of a fan may be uniformly sterilized by using a sterilizer elongated in a direction in which the fan extends.

According to at least one of the embodiments disclosed herein, a portion of an air guide is coupled with a sterilizer, thereby facilitating assembly of the sterilizer.

According to at least one of the embodiments disclosed herein, a portion of an air guide and a sterilizer may be removed together from a case, thereby facilitating repair of the sterilizer.

According to at least one of the embodiments disclosed herein, one surface of a sterilizer and one surface of an air guide form a continuous surface, thereby minimizing flow resistance caused by the sterilizer.

Although embodiments have been described with reference to a number of illustrative embodiments thereof, it should be understood that numerous other modifications and embodiments can be devised by those skilled in the art that will fall within the scope of the principles. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case defining an inlet and an outlet;

a heat exchanger disposed inside of the case;

a fan disposed inside of the case and elongated in a direction of a rotational axis of the fan;

a guide that extends toward the outlet in the rotational direction of the fan; and a sterilizer disposed on the guide and facing the fan, the sterilizer having a lamp that extends in a direction in which the fan extends, and a light source that is disposed on one side of the lamp and generates a light that is emitted toward the lamp, such that the lamp projects the light emitted from the light source toward the fan.

2. The air conditioner of claim 1, wherein the guide comprises:

a rear guide that extends in the rotational direction of the fan; and a front guide disposed downstream of the rear guide and extending toward the outlet, wherein the sterilizer is disposed on the front guide.

3. The air conditioner of claim 2, wherein the sterilizer is coupled to the front guide to be detachable from the case.

4. The air conditioner of claim 2, wherein the front guide comprises a device coupling portion recessed in a direction away from the fan, and providing a space in which the sterilizer is disposed.

5. The air conditioner of claim 2, wherein the sterilizer comprises a lamp case in which the lamp is accommodated, and which is coupled to the front guide.

6. The air conditioner of claim 2, wherein the sterilizer and the front guide extend in a direction of a rotational axis of the fan.

7. The air conditioner of claim 2, wherein the sterilizer comprises a case cover that defines a continuous surface with a surface of the front guide that faces the fan.

8. The air conditioner of claim 2, wherein the case comprises:

a front wall spaced apart from the fan, wherein the front guide comprises:

a first plate disposed below the front wall and the rear guide;

a first rib that protrudes upward from the first plate; and a second rib that protrudes upward from the first plate and spaced apart from the first rib, wherein the front wall and the rear guide are inserted between the first rib and the second rib.

9. The air conditioner of claim 2, wherein the front guide comprises a lower protrusion that protrudes toward the outlet and located below the sterilizer.

10. The air conditioner of claim 2, wherein the sterilizer comprises a case cover that defines a continuous surface with a surface of the rear guide that faces the fan.

11. The air conditioner of claim 2, wherein the rear guide comprises a guide protrusion that protrudes toward the fan and located above the sterilizer.

12. The air conditioner of claim 2, wherein the rear guide comprises a plurality of guide protrusions that protrudes toward the fan, and spaced apart from each other in a direction in which the fan extends, wherein the sterilizer comprises holders disposed at positions between the plurality of guide protrusions.

13. The air conditioner of claim 1, further comprising a drain pan disposed below the heat exchanger and located downstream from the sterilizer.

14. The air conditioner of claim 13, wherein the drain pan comprises:

a base disposed below the heat exchanger; and a first drain pan wall that extends from the base toward the sterilizer, and located downstream from the sterilizer.

15. The air conditioner of claim 13, wherein the drain pan comprises:

a first drain pan wall that extends toward the sterilizer; and a drain pan protrusion that protrudes from the first drain pan wall in a direction away from the sterilizer.

16. The air conditioner of claim 1, wherein the sterilizer further comprises a light emitting portion disposed at the one side of the lamp.

17. The air conditioner of claim 16, further comprising a fan motor disposed at one side of the fan and coupled to the fan, wherein the light emitting portion is disposed at a position corresponding to the fan motor.

18. The air conditioner of claim 1, wherein the sterilizer comprises a plurality of patterns that protrudes toward a center of the lamp, and spaced apart from each other in a direction in which the lamp extends.

19. The air conditioner of claim 18, wherein intervals at which the plurality of patterns is spaced apart are set differently in a longitudinal direction of the lamp.

20. The air conditioner of claim 18, wherein the light source is connected to the lamp, wherein the intervals between the plurality of patterns decreases as the lamp extends away from the light source.

21. An air conditioner, comprising:

a case defining an inlet and an outlet;

a heat exchanger disposed inside of the case;

a fan disposed inside of the case and extending elongated lengthwise in a lateral direction of the air conditioner;

a guide that extends toward the outlet in a rotational direction of the fan; and a sterilizer disposed on the guide and facing the fan, the sterilizer having a lamp that extends lengthwise in the lateral direction of the air conditioner, and a light source that is disposed on one side of the lamp and generates a light that is emitted toward the lamp, such that the lamp projects the light emitted from the light source toward the fan, wherein the guide comprises:

a rear guide that extends in the rotational direction of the fan; and a front guide connected to the rear guide at a downstream end of the rear guide and extending toward the outlet, and wherein the sterilizer is disposed on the front guide facing the fan.

22. An air conditioner, comprising:

a case defining an inlet and an outlet;

a heat exchanger disposed inside of the case;

a fan disposed inside of the case and extending lengthwise in a lateral direction of the air conditioner;

a guide that extend toward the outlet in a rotational direction of the fan; and a sterilizer disposed on the guide and facing the fan, wherein the sterilizer comprises:

a lamp that extends lengthwise in the lateral direction of the air conditioner;

a light source that is disposed on one side of the lamp and generates a light that is emitted toward the lamp, such that the lamp projects the light emitted from the light source toward the fan; and a plurality of patterns that protrudes toward a center of the lamp, and spaced apart from each other in the lateral direction of the air conditioner.

* * * * *